US006122814A

United States Patent [19]

Pennig et al.

[11] Patent Number: 6,122,814

[45] Date of Patent: Sep. 26, 2000

[54] METHOD FOR FORMING A RING WITH A CHAMFERED SECTION

[75] Inventors: Helmet Pennig, Weinheim; Wolfgang Nickl, Gorxheimertal; Wilhelm Dieter, Hemsbach, all of Germany

[73] Assignee: Firma Carl Freudenberg, Weinheim, Germany

[21] Appl. No.: 09/209,594

[22] Filed: Dec. 11, 1998

[30] Foreign Application Priority Data

Dec. 11, 1997 [DE] Germany ..... 197 55 104

[51] Int. Cl.[7] ..... B23P 17/00; B21D 28/00

[52] U.S. Cl. ..... 29/412; 29/423; 29/DIG. 37; 72/335; 72/338; 72/348

[58] Field of Search ..... 72/335, 338, 334, 72/348, 330, 379.2; 29/412, DIG. 37, 423

[56] References Cited

U.S. PATENT DOCUMENTS 181,356 8/1876 Milbank .
438,253 10/1890 Lorenz .
580,845 4/1897 Buxton .
1,460,749 7/1923 Dull .
2,150,708 3/1939 Andrews et al. .
2,289,409 7/1942 Connors ..... 29/412
3,050,849 8/1962 Etchison, Jr. et al. .
4,562,628 1/1986 Marneffe et al. ..... 29/412

*Primary Examiner*—David P. Bryant
*Attorney, Agent, or Firm*—Kenyon & Kenyon

[57] ABSTRACT

A process for manufacturing a ring that has at least one cylindrical end section that ends in a chamfer is disclosed. The process entails providing a flat-shaped article which is formed of a material capable of being deep-drawn. The flat-shaped article is stamped to provide indentations which correspond to the chamfer in the finished product. The flat-shaped article is then punched out to form a preform. The preform is then deep drawn, converting the preform into the shape of the ring. In the step of deep drawing the preform, the indentations form a chamfered section on the ring.

6 Claims, 2 Drawing Sheets

METHOD FOR FORMING A RING WITH A CHAMFERED SECTION

BACKGROUND OF THE INVENTION

The present invention relates to a method for manufacturing a ring having at least one cylindrical end section which ends in a chamfer.

RELATED ART

A process to produce a ring with a chamfered section is known from the prior art. The process is used, inter alia, in the production of flange rings. Flange rings are required for the manufacture of sealing gaskets which have a sealing lip made of a polymer material. The cylindrical end section of flange rings of this type have a chamfer on the external side of the ring. The chamfer makes it easier to insert the end section axially into a receiving bore. The chamfer in flange rings of this type describes a preselected angle of approximately 30° with respect to the axis of the ring. The chamfer is produced by subsequent machining of the already deep-drawn ring. The expense associated with the subsequent machining is considerable because it is difficult to pick up, clamp, and process the individual rings fully automatically, and cut them with the necessary precision.

SUMMARY OF THE INVENTION

The object of the present invention is to provide a process for making flange rings which makes it unnecessary to produce the chamfer in a subsequent machining process, while achieving significantly improved dimensional accuracy.

This object is achieved in the present invention by providing a flat article made of material which is suitable for use in a deep drawing process. The flat article is stamped to form indentations. The indentations correspond to the chamfer on the finished product. The article is then punched out to form a preform and the preform is deep drawn to form the ring. The previously formed indentations in the preform form the chamfers on the deep-drawn ring.

Provision is made in the present invention for integrating into the deep-draw process the application of the chamfer. In this context, the chamfer is applied to the preform by stamping the preform. The preform still has a planar shape during the application of the chamfer. It is thus much easier to achieve great dimensional accuracy in the area of the chamfer. In addition, from a technical point of view, it is significantly simpler perform a stamping process than it is to apply a machining process.

The stamping and the punching out of the preform can be accomplished either sequentially or together in the same work phase. A sequential execution of the stamping and punching out steps permits the use of relatively simply configured tools. Executing the stamping and the punching out together in a single step, however, has the advantage of reducing the size of the tools.

It has proven to be beneficial if, after the step of punching-out the preform, the preform is laid in the opening created by the punching-out process and is conveyed to the subsequent step by the flat-shaped article. As a result, it is not necessary to provide separate handling tools for transporting the preform further. Furthermore, the positioning of the preform in the subsequent step is extraordinarily precise because, in the punched-out opening, produced without cutting, a positioning of the preform occurs automatically, with no play. Since the flat-shaped article, in any case, is being precisely conveyed by the tool, it is thus particularly simple to deliver the prestamped preform to the next processing step with the necessary precision.

In general, the flat-shaped article is composed of a strip-shaped band, which is continually unwound from a coil. The strip-shaped band is conveyed, with sequencing control, through the tool. The preformed preform follows the motion in this regard until its completion. As a result, uncontrolled relative misplacements of the preform and subsequent deformations are largely prevented.

It has proven beneficial if the preform is deep drawn in a step subsequent to the stamping. While the preform is still planar, the chamfer defines the outer edge of the preform. During the deep draw process, the chamfer is directed to the area of a cylindrical end section of the ring. During this step, the original dimensions of the chamfer can change. Nevertheless, the changes in this regard can be measured very accurately and taken into account in the dimensioning of the prestamping tool, so that the chamfer on the finished part has the desired dimensions.

It is also possible to employ a supplemental, second stamping step for subsequent calibration of the already formed chamfer. However, this subsequent step adds further expense. Therefore, it is the general goal to provide sufficient calibration in the first stamping.

A subsequent calibration is generally utilized only when the prior calibration was not of sufficient precision. A subsequent calibration, if generally provided for, does not produce any tool wear if the calibration achieved in the first step is already of sufficient precision. By generally providing for a subsequent calibration, it is possible to achieve a zero error rate in the context of fully automatic manufacturing process.

DETAILED DESCRIPTION OF THE INVENTION

The deep-draw process according to the present invention is explained below with reference to the Figures. The individual shaping steps are depicted in FIGS. 1 through 7.

Figure 1:
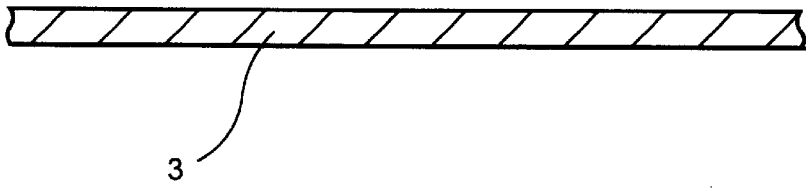
FIG. 1 shows a cross-section of the flat-shaped article before any processing has been performed.

FIG. 1 depicts, in cross-section, a flat-shaped article 3 as it arrives for processing. It is generally made of a metal plate, for example of sheet steel.

Figure 2:
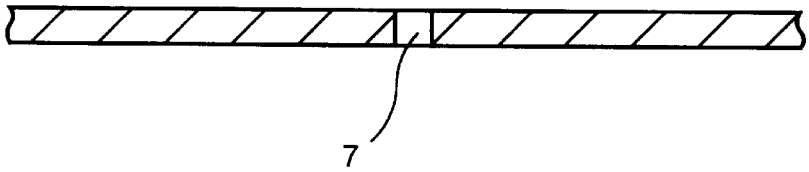
FIG. 2 shows a cross-section of the flat-shaped article after the first shaping step.

FIG. 2 illustrates the first shaping step. In this step, a centering hole 7 is formed at a preselected location in the flat-shaped article. The centering hole is formed, for example, by punching out the hole.

Centering hole 7 is produced using clock-pulse timing in sequence at preselected locations. The process is relatively simple if the flat-shaped article is generally made of a steel band, which is unwound from a coil and is conveyed further by the tool by the application of a phased forward feed. Consequently, in the steel band, which for example can be 7 cm wide, centering holes 7 are created in regular intervals, for example, of 7 cm.

Figure 3:
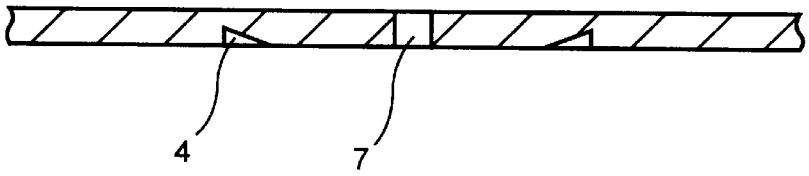
FIG. 3 shows a cross-section of the flat-shaped article after the first stamping step.

FIG. 3 depicts the process step in which the flat-shaped article is provided with a stamp 4 concentrically surrounding centering opening 7. The stamp has a conical profile. Stamp 4, if necessary, can be applied simultaneously with the step of punching out of preform 5 from flat-shaped article 3. Alternatively, stamp 4 can be applied before or after the step of punching out preform 5. To assure a concentric correlation to the centering hole, it has proven advantageous if the stamping tool is guided by a mandrel. The mandrel has a conical taper on the front end and the diameter of the mandrel corresponds to the diameter of the centering opening 7. The mandrel thus leads the stamping tool into the centering hole and, if necessary, effects a readjustment.

Figure 4:
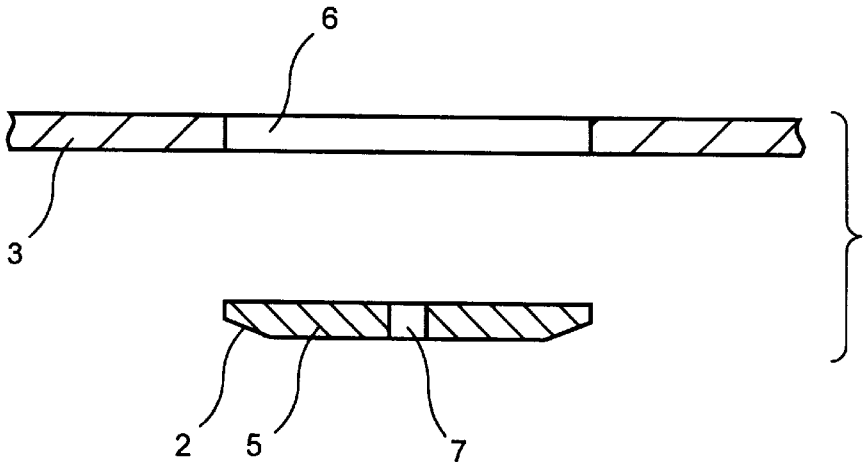
FIG. 4 shows a cross-section of the preform being punched out of the flat-shaped article.

FIG. 4 depicts a process step in which planar preform 5 is separated from flat-shaped article 3 by punching out the preform. In the area of its outer periphery, the preform has a chamfer 2 which is formed by a boundary surface of original stamp 4.

Figure 5:
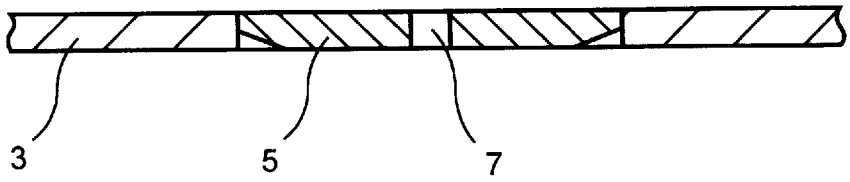
FIG. 5 shows a cross-section of the preform replaced in the flat-shaped article after it has been punched out.

FIG. 5 is a representation of that process step in which preform 5 has been guided back into opening 6 of flat-shaped article 3 created in the punching process. In response to the stepwise forward motion of flat-shaped article 3 through the entire tool, it is possible as a result to deliver preform 5 to the next processing step in a very precise manner. If necessary, a subsequent correction of the position of the preform 5 is carried out by using the centering opening 7.

Figure 6:
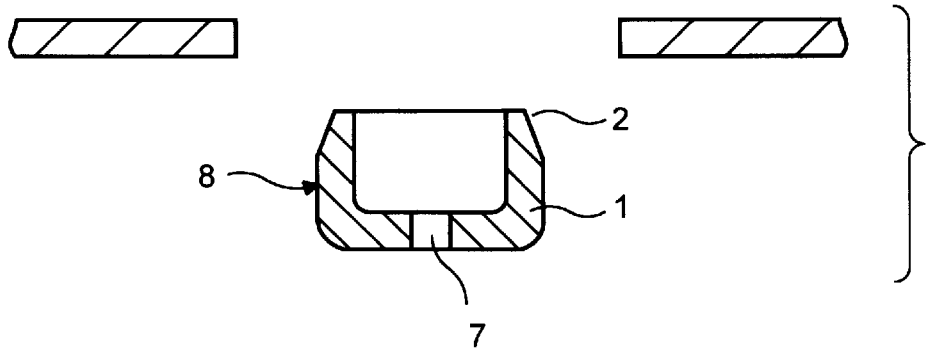
FIG. 6 shows a cross-section of the preform after it has been subjected to a deep draw process.

FIG. 6 depicts a process step in which the preform is plastically deformed by a deep-draw process. The preform has been formed into the shape of a flange ring. The flange ring has a chamfer 2 on the external side in the area of a cylindrical end section 1. It is obvious that chamfer 2, if necessary, could also be arranged on the inner side of flange ring 8, or, in a piece having a tube shape, at both ends. For this purpose, it is necessary only to provide stamp 4 at the corresponding locations where a chamfer is desired. One of ordinary skill in the art can effect these modifications.

Figure 7:
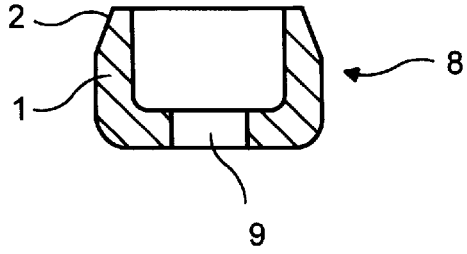
FIG. 7 shows a cross-section of the finished flange ring.

FIG. 7 depicts the flange ring 8 ready for use. The centering opening 7 is replaced by a central cutout 9. In this connection also, a punching-out process can be used in which a centering mandrel precedes the actual punching tool, the mandrel being inserted into the centering opening and effecting a readjustment of the preform to the extent required.

The process according to the present invention can be carried out fully automatically and without cutting, with the use of relatively simply configured tools. The process makes it possible to achieve zero error rates with regard to the dimensioning of the chamfer. The application is extraordinarily economical. In particular, with regard to the mass production of flange rings for the manufacture of gaskets, it is of remarkable significance.

What is claimed is:

1. A process for manufacturing a ring having at least one cylindrical end section with a chamfer, comprising the steps of:

providing a flat plate formed of a material which is capable of being deep-drawn;

stamping the flat plate to form an annular indentation having a wedge-shaped cross-section;

punching out a preform from the flat plate such that the annular wedge-shaped indentation is disposed around the periphery of the preform; and deep drawing the preform to form the ring, wherein the annular wedge-shaped indentation forms the chamfer.

2. The process according to claim 1, wherein the steps of stamping the flat plate and punching out the flat plate are performed simultaneously.

3. The process according to claim 1, wherein the steps of stamping the flat plate and punching out the flat plate are performed sequentially.

4. The process according to claim 3, further comprising the steps of:

placing the preform in the opening in the flat plate produced by the punching-out process; and conveying the flat plate, and the preform inserted therein, to the deep drawing process.

5. The process according to claim 4, wherein during the step of deep drawing, the chamfer is calibrated.

6. The process according to claim 5, wherein the flat plate is a strip-shaped band.

* * * * *